United States Patent [19]

Bernardy

[11] 4,078,954

[45] Mar. 14, 1978

[54] ILLUMINATING PYROTECHNIC COMPOSITION WHICH GENERATES GASES

[75] Inventor: Claude Bernardy, Vierzon, France

[73] Assignee: Societe Nationale des Poudres et Explosifs, France

[21] Appl. No.: 699,866

[22] Filed: Jun. 25, 1976

[30] Foreign Application Priority Data

Jul. 3, 1975 France ..... 75 20976

[51] Int. Cl.[2] ..... C06B 45/10

[52] U.S. Cl. ..... 149/19.8; 149/38; 149/63; 149/64; 149/20; 149/116

[58] Field of Search ..... 149/19.1, 19.8, 19.91, 149/38, 39, 61, 62, 63, 64, 20, 116

[56] References Cited

U.S. PATENT DOCUMENTS

| | | | |
|---|---|---|---|
| 3,697,339 | 10/1972 | Sarten et al. | 149/19.1 |
| 3,715,248 | 2/1973 | Swotinsky et al. | 149/39 |
| 3,733,223 | 5/1973 | Lohkamp | 149/61 |
| 3,865,659 | 2/1975 | Flynn et al. | 149/19.8 |
| 3,940,298 | 2/1976 | Beckert et al. | 149/19.1 |
| 3,986,907 | 10/1976 | Dillehay | 149/19.1 |

FOREIGN PATENT DOCUMENTS

| | | | |
|---|---|---|---|
| 2,256,906 | 5/1975 | France | 149/62 |
| 2,164,437 | 7/1973 | Germany. | |

*Primary Examiner*—Edward A. Miller

*Attorney, Agent, or Firm*—Bucknam and Archer

[57] ABSTRACT

An illuminating pyrotechnic composition comprising a stable inorganic combustion-supporting agent, a nitrated carbohydrate as a high energy binder, at least one non-volatile organic combustible compound whose combustion is exothermic overall and, optionally, a metallic constituent. Such a composition is readily ignitable and combustible and is particularly useful in block form in a signal flare or firework.

16 Claims, No Drawings

ILLUMINATING PYROTECHNIC COMPOSITION WHICH GENERATES GASES

The present invention relates to illuminating pyrotechnic compositions and to propellant compositions, particularly those in block form, and to pyrotechnic articles which comprise such compositions. Such articles are particularly useful as signal flares and fireworks.

Many types of illuminating pyrotechnic compositions exist, amongst which pulverulent compositions are the oldest. These, however, suffer from many disadvantages, including the need to use special packaging and, in particular, a starter system, and the danger of handling the compositions between the mixing of the constituents and the final packaging. Illuminating pyrotechnic compositions which can be used in block form were developed many years ago using binders which are principally:

either polymers such as polyester resins, which suffer from the severe disadvantage of yellowing the flame, and giving compositions, the combustion of which emits light which does not have as pure a spectrum as could be obtained by the sole combustion of emitter metals, such as alkali and alkaline earth metals, or binders based on carbohydrates, such as gums, dextrins or starches, which binders are moisture-sensitive and difficult to light, and furthermore require moistening with water, which is incompatible with the use of certain metals and requires a supplementary drying operation at the end of the manufacturing process.

U.S. Pat. No. 3,715,248 describes illuminating compositions comprising nitrocellulose as the binder. This choice of binder reduces the yellowing of the flame, but these compositions comprise, as the combustible substance, a very high percentage of a metal, such as aluminium and magnesium, which renders the flame whitish and detracts from the spectrum of the light emitted.

Regardless of the purity of the colour of the flame and of the light emitted, the illuminating compositions currently known tend to give rise to a spray of incandescent particles and form a plume of flames only with difficulty, owing to the fact that they do not generate sufficient gas. This insufficient generation of gas furthermore restricts their use as a propellant in pyrotechnic articles using these compositions and necessitates the use of either a special launching system or the production of a complex article containing a propellant composition and an illuminating composition, and it is well known, for example, that during a firework display there are many completely dark moments between lighting the fuse on the ground and its conflagration in the sky.

We have now developed an improved illuminating pyrotechnic composition which avoids or reduces the disadvantages of the prior art compositions referred to above.

According to the present invention, we provide an illuminating pyrotechnic composition, which comprises, based on the total weight of the composition:

(a) from 30 to 75% of a stable inorganic combustion-supporting agent which contains at least one alkali metal or alkaline earth metal nitrate, (b) from 3 to 20% of a nitrated carbohydrate as a high energy binder, (c) from 12 to 60% of at least one non-volatile organic combustible compound which is stable up to a temperature of 100° C and of which the combustion is exothermic overall, the compound containing carbon and nitrogen, not more than two carbon atoms being linked directly to one another in any part of its molecule, and (d) from 0 to 15% of a metallic constituent, the proportion of (d) not exceeding that of (c), the relative proportions of the constituents (a)–(d) being such that the composition can be ignited and can undergo combustion.

Preferably, the compound (c) comprises at least two carbon-nitrogen bonds, at least one carbon-nitrogen heterocyclic ring, at least one multiple bond between a carbon atom and a nitrogen atom and/or only contains carbon atoms which are chemically linked to atoms other than carbon.

The existence of a multiple bond between a carbon atom and a nitrogen atom is particularly important from the point of view of the ease of lighting and the combustibility of the composition, although the use of a higher energy binder, such as nitrocellulose, enables satisfactory results to be obtained even if the compound (c) does not contain such a bond. If the compound (c) contains two carbon atoms linked directly to one another, it is preferred that at least one of these carbon atoms is linked to an electronegative atom selected from nitrogen, oxygen, sulphur, chlorine, bromine and iodine.

We found, during the development of the invention, that the two principal causes of the deterioration of the light emitted by the flame are, firstly, the use of too much metallic combustible substance, which produces a whitish flame, and, secondly, the use of organic compounds containing a hydrocarbon chain, the yellowing of the flame being the greater, the higher the number of carbon atoms linked directly to one another. It is preferred, therefore, that the proportion of the metallic constituent (d) should not be more than 65% of that of the compound (c). Furthermore, we found that the use of an organic compound containing at least one carbon-nitrogen bond is essential, firstly in order to obtain a very pure flame, and secondly in order to generate a large volume of gas which enables the composition to be used to effect propulsion, and expansion of the flame into a plume, thus increasing the visibility of such a flame.

Since the amount of the metallic combustible substance which can be used is limited, there is a need to use a combustible compound which is exothermic, this condition being the more important the lower the proportion of binder in the composition and the more it is desired to obtain, on the other hand, rates of combustion which are not too low, and a high luminosity.

The many characteristics which the organic combustible compound must exhibit considerably limit its choice. The following compounds are those which are preferred, although it should be understood that any other compound which meets the criteria specified above may be used:

dicyandiamide $$NH_2-\underset{\underset{NH}{\|}}{C}-NH-C\equiv N$$

cyanamide (which tends to dimerise)

$$NH_2-C\equiv N$$

melamine (or tricyantriamide)

-continued

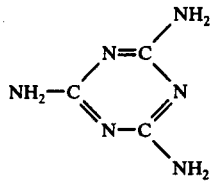

cyanuric acid

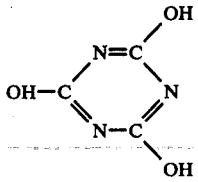

tri-(hydroxyethyl) isocyanurate

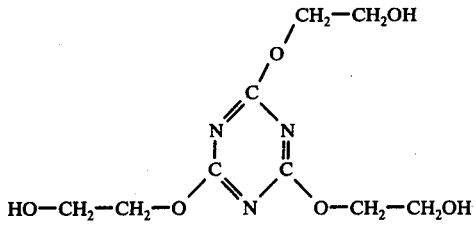

hexamethoxymethylmelamine

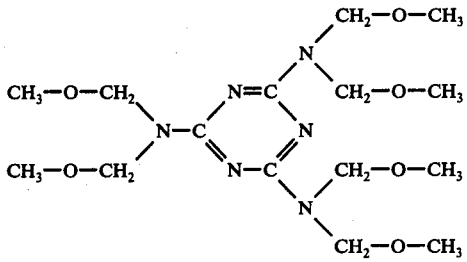

aminotetrazole

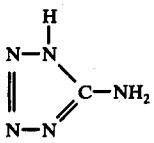

azotetrazole

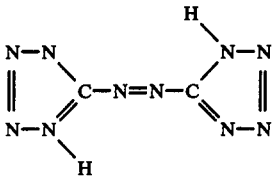

ethyleneurea

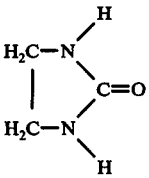

glycoluril

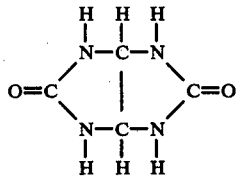

hexamethylenetetramine

-continued

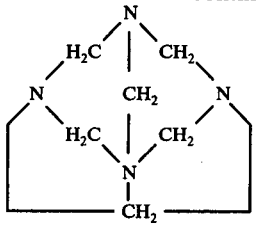

dimethylurea

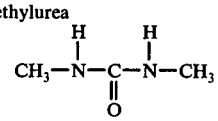

dimethylolurea

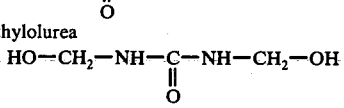

azodicarbonamide

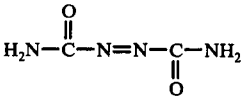

Constituent (c) must have a combustion reaction which is exothermic overall, but can be a mixture of organic compounds, some of which have an endothermic combustion reaction. In the light of the foregoing requirement, that is of overall exothermicity, constituent (c) may, for example, consist of any of the following alone: dicyandiamide, cyanamide, melamine, tri-(hydroxyethyl)-isocyanurate, hexamethylenetetramine and hexamethyoxymethylmelamine; mixtures of two or more of these compounds, can, of course, also be used. The following compounds have an endothermic combustion reaction: cyanuric acid, azotetrazole, aminotetrazole, ethyleneurea, glycoluril, dimethylurea, dimethylolurea and azodicarbonide and none of these compounds, or combinations thereof, can be used alone as constituent (c); they must be used, singly or in combination, with one or more compounds from the previous list. The use of such mixtures containing compounds from the second list may be advantageous; for example cyanuric acid has the advantage of reducing the amount of solid combustion residues.

If a mixture of compounds is used as constituent (c), one of them is preferably dicyandiamide.

In a particularly preferred embodiment, the composition comprises, based on the total weight of the composition, 40 to 70% of (a), 5 to 20% of (b), and 12 to 45% of (c), and 0 to 15% of (d). The relative proportions of the various constituents are preferably so chosen that during combustion, the stable combustion-supporting agent (a) substantially ensures the conversion, firstly, of the carbon in the composition to carbon monoxide and, secondly, of the hydrogen in the composition to water. The combustion gases of the composition are practically free from carbon monoxide because of atmospheric oxygen, which completes the combustion process.

In another preferred embodiment of the invention, the weight ratio of the organic combustible compound (c) and the metallic constituent (d), on the one hand, to the stable inorganic combustion-supporting agent (a), on the other, is from 0.2 to 1:1. Advantageously, the total weight of the nitrated carbohydrate (b) and the organic combustible compound (c) is from 25 to 50% by weight of the composition.

The stable combustion-supporting agent (a) can also be a mixture, but at least one of the inorganic compounds must be an alkali metal or alkaline earth metal nitrate. The other inorganic compounds can be other metal nitrates, for example lead nitrate which produces practically no coloration of the flame, or copper nitrate, which gives a green or blue flame and is very hygroscopic, or chlorates or perchlorates which facilitate starting but which are delicate to handle and produce disagreeable fumes. The alkali metal and alkaline earth metal nitrates are at one and the same time very rich combustible-supporting agents and high quality colouring agents, to the extent that the rise in temperature obtained on combustion is sufficient to activate their emissivity. At the same time, the other constituents in the combustion should produce the minimum of flame coloration, of fumes and of solid residues. The stable combustion-supporting agent (a) preferably consists solely of at least one alkali metal or alkaline earth metal nitrate, with the proportions of the different nitrates depending on the desired coloration or the conditions of ignition, especially when potassium nitrate is used.

The nitrated carbohydrate (b) is preferably nitrocellulose, which has a high nitrogen content (dinitrocellulose), because this compound is a very efficient binder for shaping the composition, whilst only very slightly colouring the flame due to the production of carbon monoxide; furthermore, this carbohydrate has a particularly high energy content and generates gas, which assists the role of the combustible compound (c), which also generates gas on combustion. Although it is well known in the field of pyrotechnics that it is not possible to obtain compositions which are storage stable by using a combination of a carbohydrate and a compound of alkaline character, we have found that compositions which contain as much as 20% by weight of nitrocellulose and as much as 60% by weight of the organic combustible compound(s) (c) have only a very slight instability, and that the properties of these compositions were substantially unchanged after a storage of 3 years, with only slight protection from external moisture. Other nitrated carbohydrates, for example nitrated starch, can be used, but the ease of the hydrolysis reaction causes this binder to be of less interest than nitrocellulose, because the latter permits efficient coating of all the pulverulent constituents, which results in an improvement in the storage stability of the composition. This stability is such that it is possible to add to the nitrocellulose-based composition, many special ingredients which are normally delicate to use, such as decomposition catalysts, agents for colouring the flame or the composition, and magnesium; this stability can be improved still further, when it comes to pyrotechnic articles, by encasing the blocks of the composition by coating them with or by dipping them in an insulating material.

The metallic constituents can be a metal, such as aluminium or magnesium, or an alloy. Aluminium having a very small particle size and magnesium powder or flakes are particularly suitable.

The preparation and shaping of the composition generally makes it necessary to plasticise the nitrated carbohydrate, but since the plasticisers have a carbon structure which can cause a yellowing of the flame it is particularly advantageous, firstly to limit the amount of plasticiser to 25% of the total weight of the nitrated carbohydrate, and secondly to use a plasticiser which has a few carbon atoms linked directly to one another as possible. A suitable plasticiser is polyethylene glycol.

When the shaped composition is required to have good mechanical properties, it is preferable that it should contain a plastic binder in an amount of less than 8% of the total weight of the composition. Where special coloration effects are desired or where particular combustibility characteristics are necessary, it is preferable that the composition should contain a colouring agent and/or a decomposition catalyst.

The conventional techniques used in the field of pyrotechnics, both as regards the equipment to be employed, the precautions to be taken and the safety rules to be observed are used in making the compositions according to the invention. However, the manufacture of these compositions is generally less hazardous than the manufacture of previously known compositions and an easing of the safety precautions is usually possible. One method of making the composition is as follows. The nitrated carbohydrate binder is wetted with a volatile organic solvent, such as a ketone, an ether or an alcohol, and the remaining constituents are then added and the whole is thoroughly mixed and then shaped. Mixing is greatly facilitated by the presence of the solvent, which is subsequently eliminated. When nitrocellulose is used as the binder, it is preferably dissolved in the form of collodion.

The advantages of the compositions of the present invention are, firstly, that they produce sufficient gas to ensure the formation of a plume of flames and, where appropriate, the propulsion of a pyrotechnic article with production of a coloured flame, which represents an important advance especially for display purposes, and secondly, that a very pure and very bright light is obtained on their combustion; the compositions furthermore have the advantages of producing a very limited amount of fumes and of combustion residues, of being able to burn at a great variety of speeds, of being very easy to light and extinguish, and of giving satisfactory uniform combustion, which can furthermore be achieved even with low energy compositions at a low rate of combustion.

In order that the invention may be more fully understood, the following Examples, in which all percentages are by weight, are given by way of illustration only.

EXAMPLE 1

| | |
|---|---|
| Sodium nitrate | 50% |
| dicyandiamide | 40% |
| nitrocellulose | 10% |

The above constituents were thoroughly mixed and extruded to form sticks of 8 mm diameter; these sticks, once they were dried, could be readily lit with a match and burned to give a beautiful yellow light, the combustion rate of the sticks being about 5 cm. per minute.

EXAMPLE 2

| | |
|---|---|
| Barium nitrate | 66% |
| dicyandiamide | 17% |
| nitrocellulose | 17% |

After mixing the above constituents, the paste obtained were calendered to give sheets, which were cut and then dried. The plates obtained could be lit easily and burned with an attractive green flame. The coloration of the flame could be modified, if desired, by the addition of colouring agents, such as copper salts and boron derivatives.

EXAMPLE 3

| | |
|---|---|
| Strontium nitrate | 61% |
| dicyandiamide | 17% |
| nitrocellulose | 11% |
| aluminium | 11% |

The nitrocellulose was used as granules containing 18% of polyethylene glycol, and the aluminium had a mean particle size of about 20 microns. A mixture of these constituents was moistened with acetone and was then moulded and dried. The pieces obtained could be lit easily and burned to form a characteristic cascade effect produced by the incandescence of the lighted aluminium particles.

EXAMPLE 4

| | |
|---|---|
| Strontium nitrate | 50.5% |
| dicyanidiamide | 9% |
| cyanuric acid | 24% |
| nitrocellulose | 10% |
| magnesium | 2.5% |
| polyvinyl chloride | 4% |

The paste obtained by mixing the above constituents was compression-moulded and then dried; the composition obtained burned very slowly with a bright red flame. The use of cyanuric acid, which has an endothermic combustion reaction, enabled the combustion rate to be as low as about 3 cm/minute. Such a composition is particularly suitable for signalling purposes. A triggering device can be added to a pyrotechnic article comprising this composition so as to facilitate its lighting.

EXAMPLE 5

| | |
|---|---|
| Strontium nitrate | 60% |
| dicyandiamide | 23.5% |
| nitrocellulose | 5.5% |
| magnesium | 11% |

A composition of the above constituents burned with a combustion rate of about 1 cm/second, and gave a red light of high intensity. Such a composition is particularly suitable for aerial illumination.

EXAMPLE 6

| | |
|---|---|
| Strontium nitrate | 55% |
| potassium nitrate | 6% |
| dicyandiamide | 25% |
| nitrocellulose | 5.5% |
| magnesium | 8.5% |

The above composition produced a purplish-pink light which tended to violet if the percentage of potassium nitrate was increased. However, this increase was accompanied by difficulties in lighting and in maintaining uniform combustion.

EXAMPLE 7

| | |
|---|---|
| Barium nitrate | 67% |
| dicyandiamide | 10% |

-continued

| | |
|---|---|
| azodicarbonamide | 8% |
| nitrocellulose | 15% |

The presence of the azodicarbonamide gave a composition which burned more slowly than the composition of Example 2, whilst giving similar flame properties.

EXAMPLE 8

| | |
|---|---|
| Strontium nitrate | 52% |
| dicyandiamide | 11% |
| dimethylolurea | 26% |
| nitrocellulose | 11% |

This composition also had a low combustion rate.

EXAMPLE 9

| | |
|---|---|
| Strontium nitrate | 59.2% |
| dicyandiamide | 27.2% |
| aminotetrazole | 6.8% |
| nitrocellulose | 6.8% |

EXAMPLE 10

| | |
|---|---|
| Strontium nitrate | 67.5% |
| dicyandiamide | 16.5% |
| hexamethoxymethylmelamine | 11% |
| nitrocellulose | 5% |

This composition was produced in the form of a mass which could be granulated to a moulding powder.

EXAMPLE 11

| | |
|---|---|
| Strontium nitrate | 55% |
| dicyandiamide | 16.5% |
| hexamethoxymethylmelamine | 9% |
| nitrocellulose | 7% |
| polypropylene oxide | 1.5% |

This composition was made into a mouldable granular powder.

EXAMPLE 12

| | |
|---|---|
| Barium nitrate | 65% |
| hexamethoxymethylmelamine | 19% |
| nitrocellulose | 16% |

This composition was produced in the form of a mouldable paste.

EXAMPLE 13

| | |
|---|---|
| Strontium nitrate | 58.2% |
| hexamethoxymethylmelamine | 20.4% |
| nitrocellulose plasticised with 18% of polypropylene glycol | 11.4% |

This composition was in the form of a plastic mass and gave a pale red flame which could be intensified by adding a lithium salt.

EXAMPLE 14

| | |
|---|---|
| Strontium nitrate | 74.8% |
| hexamethylenetetramine | 19.5% |
| nitrocellulose plasticised with 18% of polypropylene glycol | 5.7% |

This composition was produced in the form of a powder. It was easy to light, burned with negligible fumes and could be stored in a simple plastic bag.

The illuminating pyrotechnic compositions of the present invention are particularly suitable for the production of solid blocks, such as sticks, plates or cylinders, which are used in pyrotechnic articles, such as distress flares, aeronautical items which allow temporary illumination, and fireworks.

I claim:

1. An illuminating pyrotechnic composition, useful to produce visible flares, which consists essentially of, based on the weight of said composition:

(a) From about 30 to about 75% of a stable inorganic combustion-supporting agent which contains at least one alkali metal or alkaline earth metal nitrate, (b) from about 3 to about 20% of a nitrated carbohydrate as a high energy binder, (c) from about 12 to about 60% of a non-volatile organic combustible constituent which is stable up to a temperature of about 100° C, said constituent being at least one member selected from a first group consisting of dicyandiamide, cyanamide, melamine, tri(hydroxyethyl) isocyanurate, and hexamethoxymethylmelamine, or being at least one member of said first group with at least one member selected from a second group consisting of cyanuric acid, azotetrazole, amino-tetrazole, ethyleneurea, glycoluril, dimethylurea, dimethylolurea, and azodicarbonamide, the combustion of said constituent being exothermic overall, and (d) from 0 to about 15% of a metallic constituent, and said metalic constituent consisting of at least one metal selected from the group consisting of aluminum and magnesium, the proportion of (d) not exceeding that of (c), the relative proportions of said constituents (a)–(d) being such that said composition can be ignited and can undergo combustion.

2. A composition as set forth in claim 1, in which said constituent (c) is at least one compound selected from the group consisting of dicyanamide, cyanamide, melamine, tri-(hydroxyethyl)-isocyanurate, and hexamethoxymethylmelamine.

3. An illuminating pyrotechnic composition, useful to produce visible flares, which consists of, based on the weight of said composition:

(a) from about 30 to about 75% of a stable inorganic combustion-supporting agent which contains at least one alkali metal or alkaline earth metal nitrate, (b) from about 3 to about 20% of a nitrated carbohydrate as a high energy binder, (c) from about 12 to about 60% of a non-volatile organic combustible substance which is stable up to a temperature of about 100° C the combustion of which is exothermic overall, said substance being at least one member selected from the group consisting of dicyandiamide, cyanamide, melamine, tri(hydroxyethyl) isocyanurate, hexamethoxymethylmelamine, and further being at least one member selected from the group consisting of cyanuric acid, azotetrazole, aminotetrazole, ethyleneurea, glycoluril, dimethylurea, dimethylolurea and azodicarbonamide, (d) from 0 to 15% of a metallic constituent, said metallic constituent consisting of at least one metal selected from the group consisting of aluminum and magnesium, the proportion of (d) not exceeding that of (c), the relative proportions of said constituents (a)–(d) being such that said composition can be ignited and can undergo combustion.

4. A composition as set forth in claim 1, in which said constituent (c) consists of at least two organic combustible compounds, one of which is dicyandiamide.

5. A composition as set forth in claim 1, in which said constituent (a) consists solely of at least one alkali metal or alkaline earth metal nitrate.

6. A composition as set forth in claim 1, in which said binder (b) is nitrocellulose.

7. A composition as set forth in claim 1, wherein the amounts based on the total weight of said composition, are about 40 to 70% of (a), about 5 to about 20% of (b), about 12 to about 45% of (c), and 0 to about 15% of (d).

8. A composition as set forth in claim 1, in which the weight ratio of (c) plus (d) to (a) is from about 0.2 to 1:1.

9. A composition as set forth in claim 1, in which said constituent (b) includes a plasticiser therefor which amounts to not more than 25% of the weight thereof.

10. A composition as set forth in claim 1, in which the proportion of said metallic constituent (d) is not more than 65% of said constituent (c).

11. A composition as set forth in claim 1, which additionally includes at least one of a colouring agent and a decomposition catalyst.

12. A composition according to claim 2 which consists of 50% sodium nitrate, 40% dicyandiamide and 10% nitrocellulose.

13. A composition according to claim 2 which consists of 66% barium nitrate, 17% dycyandiamide, 17% nitrocellulose.

14. A composition according to claim 2 which consists of 61% strontium nitrate, 17% dicyandiamide, 11% nitrocellulose, 11% aluminum.

15. A composition according to claim 4 which consists of 50.5% strontium nitrate, 9% dicyandiamide, 24% cyanuric acid, 10% nitrocellulose, 2.5% magnesium, 4% polyvinyl chloride.

16. A composition according to claim 2 which contains 60% strontium nitrate, 23.5% dicyandiamide, 5.5% nitrocellulose, 11% magnesium.

* * * * *